US005473524A

United States Patent [19]

Behringer

[11] Patent Number: 5,473,524

[45] Date of Patent: Dec. 5, 1995

[54] FIELD OF ACTION LIGHT FOR MEDICAL, PARTICULARLY DENTAL PRACTICE

[75] Inventor: Wolfgang Behringer, Bensheim-Wilmshausen, Germany

[73] Assignee: Siemens Aktiengesellschaft, Munich, Germany

[21] Appl. No.: 100,135

[22] Filed: Aug. 2, 1993

[30] Foreign Application Priority Data

Aug. 11, 1992 [DE] Germany ..... 42 26 594.0

[51] Int. Cl.[6] ..... F21V 29/00

[52] U.S. Cl. ..... 362/294; 362/226; 362/804; 362/293; 362/373

[58] Field of Search ..... 362/294, 804, 362/373, 263, 264, 327, 226, 319, 293, 376

[56] References Cited

U.S. PATENT DOCUMENTS

| | | | |
|---|---|---|---|
| 3,703,635 | 11/1972 | Burkarth | 362/264 |
| 4,380,794 | 4/1983 | Lawson | 362/294 |
| 4,837,668 | 6/1989 | Koehler | 362/804 |
| 5,199,785 | 4/1993 | Scholz | 362/804 |

FOREIGN PATENT DOCUMENTS

| | | |
|---|---|---|
| 0396219 | 11/1990 | European Pat. Off. . |
| 1072776 | 9/1954 | France . |
| 1108909 | 1/1956 | France . |
| 3807584 | 9/1989 | Germany . |
| 9013302 | 1/1991 | Germany . |
| 2100403 | 12/1982 | United Kingdom . |
| WO91/14131 | 9/1991 | WIPO . |

*Primary Examiner*—Ira S. Lazarus
*Assistant Examiner*—Sara Sachie Raab
*Attorney, Agent, or Firm*—Hill, Steadman & Simpson

[57] ABSTRACT

A work place light fixture is presented wherein a shielding is provided for improved heat elimination and avoids heating of the reflector, this shielding being fashioned transparently at least in the region of the light which charges the reflector and essentially contains only face-side cooling air entry apertures lying in front of the reflector and exit apertures lying behind the reflector.

14 Claims, 3 Drawing Sheets

FIELD OF ACTION LIGHT FOR MEDICAL, PARTICULARLY DENTAL PRACTICE

BACKGROUND OF THE INVENTION

The invention is directed to a field of action light for medical, particularly dental practice, whereby the lamp member containing at least one lamp and one reflector is provided with means for eliminating the heat generated by the lamp.

In the known light of this type such as U.S. Pat. No. 4,254,454, which comprises a reflector that resides upright and is rectangular in plan view, a light-transmissive protective shield is arranged in front of the light, this protective shield forming a chamber together with the reflector and the housing of the light in whose center the lamp is located. The protective shield forms lateral openings in the region of the lamp via which cooling air can enter. Further gaps or, respectively, openings via which the heated air can emerge are formed together with the protective shield at the under edge and upper edge of the reflector as well as laterally therefrom.

An air circulation due to convection and, thus, elimination of the heat generated by the lamp is achieved with this design. What is thereby disadvantageous is that the warm air necessarily flows over the reflector and thereby unnecessarily heats it. As a consequence of the air circulation within the chamber, moreover, dust and other particles can constantly deposit on the protective shield and on the reflector, as a result whereof frequent cleaning of the reflector is necessary, this being possible in the said light only on the basis of a relatively complicated design. To this end, namely, the reflector is held at the housing of the light in a fashion so that it can be pivoted back. This pivotability requires relatively narrow manufacturing tolerances in order to achieve an exact adjustment of reflector and lamp.

The above disadvantages also apply to a multiple reflector system disclosed by U.S. Pat. No. 3,703,635 which is essentially provided for high-performance lamps, for example xenon high-pressure lamps in the power range between 2 and 8,000 Watts. The reflector system contains four reflectors, some of these being rigidly arranged and others being adjustably arranged in order to be able to vary the beam width from, for example, spot to flood. Axial ventilators are arranged at both ends of the reflector system for cooling. The front ventilator is arranged in a tube that extends in the direction of the reflector axis; the tube, however, only surrounds the lamp in a base region, i.e. only extends over a part of the lamp length. The tube contains radial slots both in the region of the front axial ventilator as well as in the region of the reflector, the air being capable of being suctioned in via these radial slots and being blown onto the reflector for cooling thereof.

U.S. Pat. No. 5,134,554 discloses an illumination system having a halogen lamp, whereby the lamp is surrounded by a pear shaped protective bell. The protective bell is provided with air outflow channels at its rear end with which it is secured to the base mount. The protective bell itself contains no air inflow opening.

British Patent 2 123 132 discloses a combined ventilator and illumination means that is preferably provided for fastening to the ceiling of a room. The means comprises a light fixture housing in which a ventilator and a fluorescent lamp are arranged. Two motors are arranged axially behind one another in the ventilator housing; one drives the ventilator wheel and a second turns a lamp shade at which the light as well as the cooling air emerge, as a result whereof the air outflow slots arranged in the lamp shade can be changed in position. The air exit direction can be varied with such an adjustment, and, thus, the air stream can be individually varied. In this elimination means, the light emanating from a fluorescent lamp emerges directly via slots; the illumination means thus contains no reflector. Further, no air inflow openings are present, either.

SUMMARY OF THE INVENTION

The object of the present invention is to create an improved field of action light that, while avoiding a heating of the reflector and other parts that can be touched from the outside during manipulation, also assures a good elimination of the heat produced by the lamp and also assures a good cleaning of the reflector without dismantling parts.

The inventive shielding is part of a heat conducting means that assures that air can proceed into the system only at the front edge of the lamp and can only in turn emerge therefrom at the opposite side, i.e., at the back side of the reflector. The reflector is otherwise freely accessible and requires no large-area guard shield. In order to intensify the chimney effect that derives due to the design of the invention, an electrically driven ventilator can be additionally provided. When the light, as currently standard, is operated with a halogen lamp or with some other gas-filled lamp, then it is advantageous to fashion the transparent section explosion-proof, for example to fabricate it of suitable safety glass. It is also advantageous to fabricate this transparent section of ultraviolet-absorbent material or to provide the inside of this section with a coating that reflects ultraviolet radiation.

Further advantages derive from the following description of an exemplary embodiment.

DETAILED DESCRIPTION OF THE PREFERRED EMBODIMENTS

Figure 1:
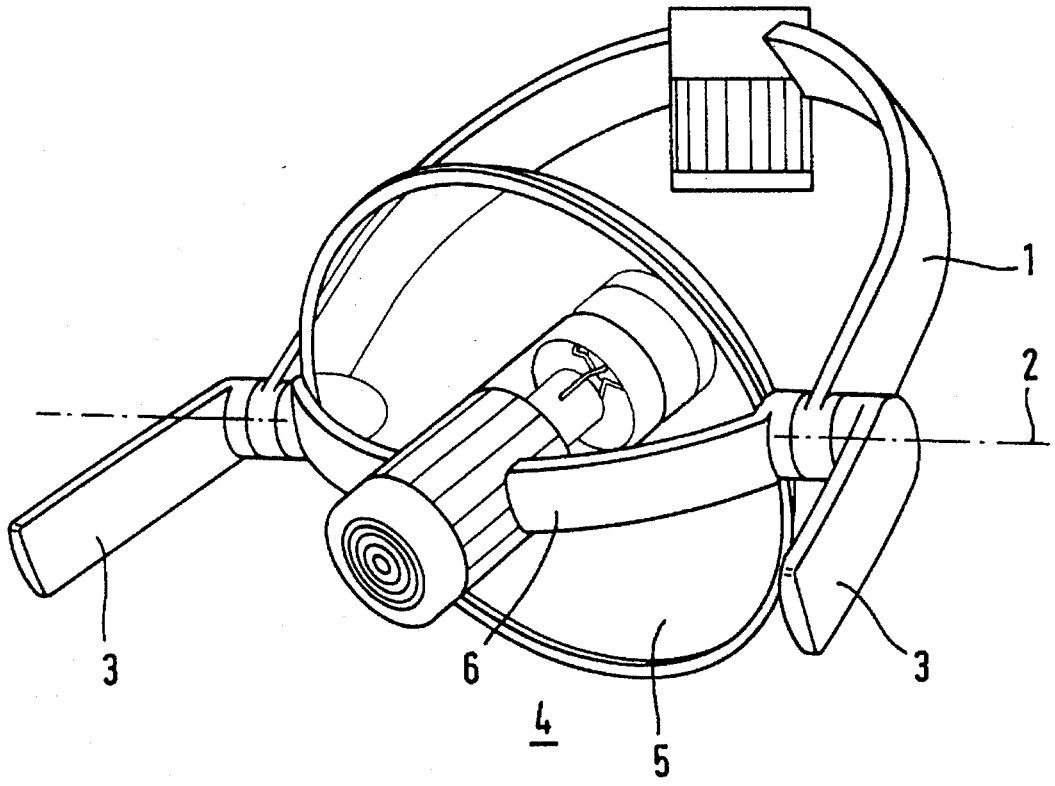
FIG. 1 is a schematic perspective view of a dental field of action light.

FIG. 1 illustrates a dental field of action light having a carrying strap 1 that can be secured to a wall or ceiling bracket (not shown). A lamp assembly referenced 4 overall is swivelly arranged along a horizontal swivelling axis 2 and is swivelled with the assistance of laterally arranged grips 3. The lamp assembly 4 comprises a glass reflector 5 open toward the front, i.e. in illumination direction. The lamp assembly 4 is swivelly connected to the carrying strap 1 by a carrier part 6.

Figure 2A:
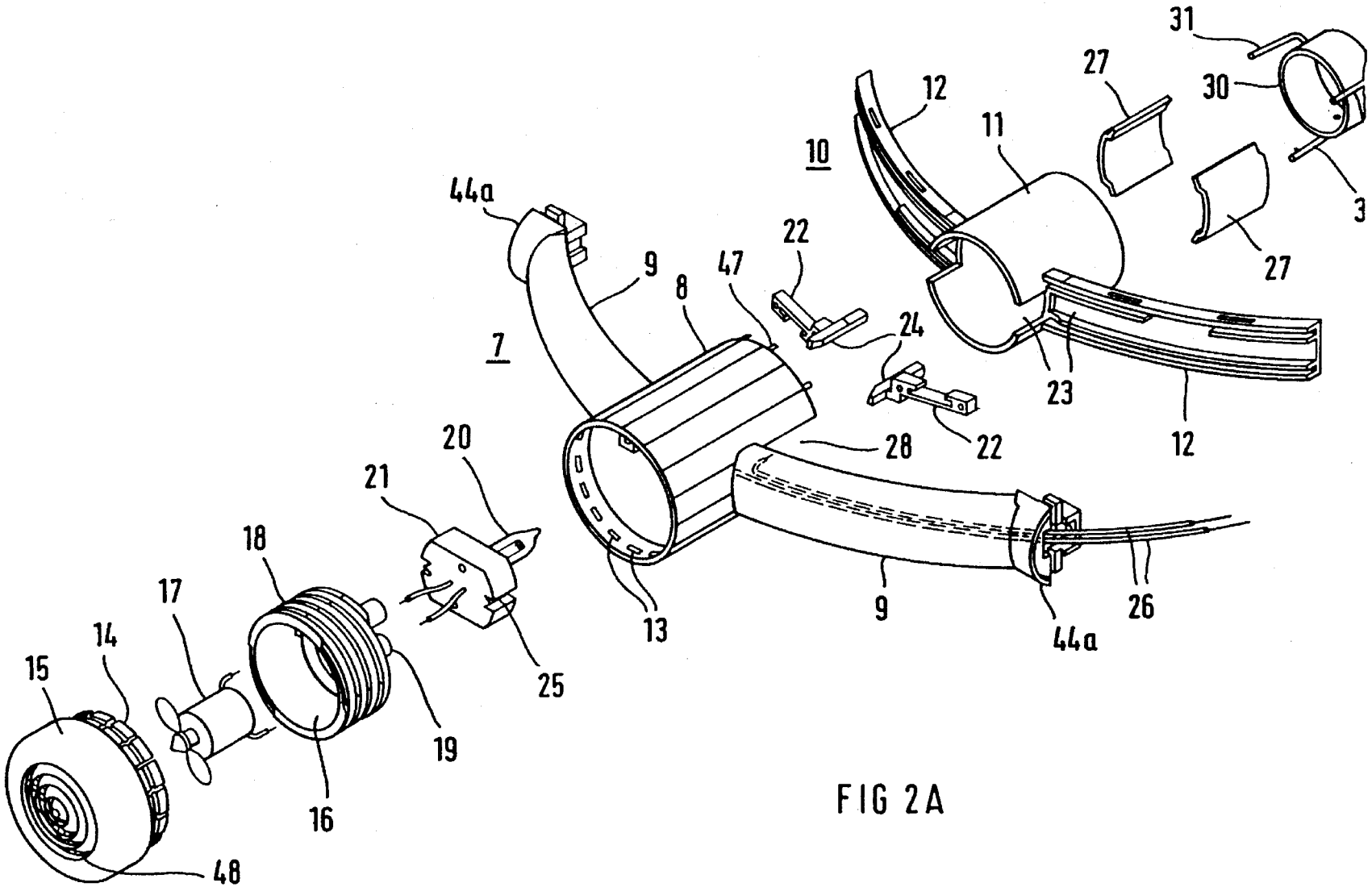
FIG. 2A is an exploded perspective view of a portion of the light of FIG. 1.

As may be seen from FIG. 2A, the reflector carrier part 6, fashioned bow-like, is composed of two halves, a front part 7 having a centrally arranged, cylindrical outside housing 8 and lateral arms 9 secured thereto at both sides, and of a rear part 10 which contains an inside housing 11 that fits into the outside housing 8 and having lateral arms 12 secured at both sides of housing 8 that partially engage into the lateral arms 9 of the front carrier part when the parts 7, 10 are joined.

The cylindrically fashioned outside housing 8 contains a plurality of tabs 13 at its circumference in the front end region thereof, these tabs 13 interacting with resilient elements 14 of a ventilator cap 15 and forming a snap-in connection that axially fixes the two parts when the ventilator cap 15 is installed.

A ventilator housing 16 accepts an electrically driveable ventilator 17 and whose outside circumference comprises a trapezoidal thread 18 that interacts with corresponding engagement means, such as threads, of the ventilator cap 15 that cannot be seen in the figure. The ventilator housing 16 is provided with fastening pins 19 to which a base 21 that accepts a lamp or bulb 20 can be secured.

In the assembled condition, the ventilator housing 16 together with the ventilator 17 and ventilator cap 15 form a structural unit with the lamp 20 and the base 21, this structural unit being arranged axially engageable in the outer housing 8 of the front carrier half 7 on the basis of the snap-in connection 13, 14 and being arranged easily releasable in axial direction for changing the lamp. The snap-in connection is designed such that the ventilator cap can be turned in the engaged condition. Given a rotation of the ventilator cap 15, the ventilator housing 16 and, thus, the base secured thereto can be axially displaced via the engagement with the trapezoidal thread 18, as a result whereof an optimum setting of the focus of the lamp with respect to the reflector can be achieved.

The electrical supply of the lamp 20 ensues via electrical wiper contact elements 22 that are held in recesses 23 arranged at both sides of the inner housing 11 and are also held in the lateral arms 12 of the rear carrier half 10. The wiper contact elements 22 are provided with contact rails 24 that correspond to resilient contact surfaces 25 in the base 21. The arrangement is undertaken such that a contacting is guaranteed given the abovedescribed longitudinal displaceability of the ventilator housing and, thus, of the base within the displacement path. The contact elements 22 are connected to the ends of electrical leads 26 that are laid in the hollow space of the one lateral arm formed by the two carrier halves and that are conducted into the carrying strap via a swivelling articulation 44*a*. The electrical supply of the ventilator 17 can ensue via separate, further lines (not shown) that are likewise guided in one of the lateral arms and are brought to the ventilator 17 via clearances in the base 21.

Two cover plates are referenced 27, these, after the assembly of the two carrier halves 7 and 10, covering the recess 28 in the front carrier half 7 needed for the assembly. The outside housing 8 has its circumference completely closed as a result thereof.

A screen ring 30 is installed approximately in the region of the lamp helix in the assembled condition and serves, on the one hand, as a protection against heat and, on the other hand, for blanking scattered rays that arise in the region of the outside edge of the reflector. The screen ring 30 is secured axially displaceable with the assistance of retainer elements 31 in the inside housing 11 but is securely protected against twisting.

Figure 2B:
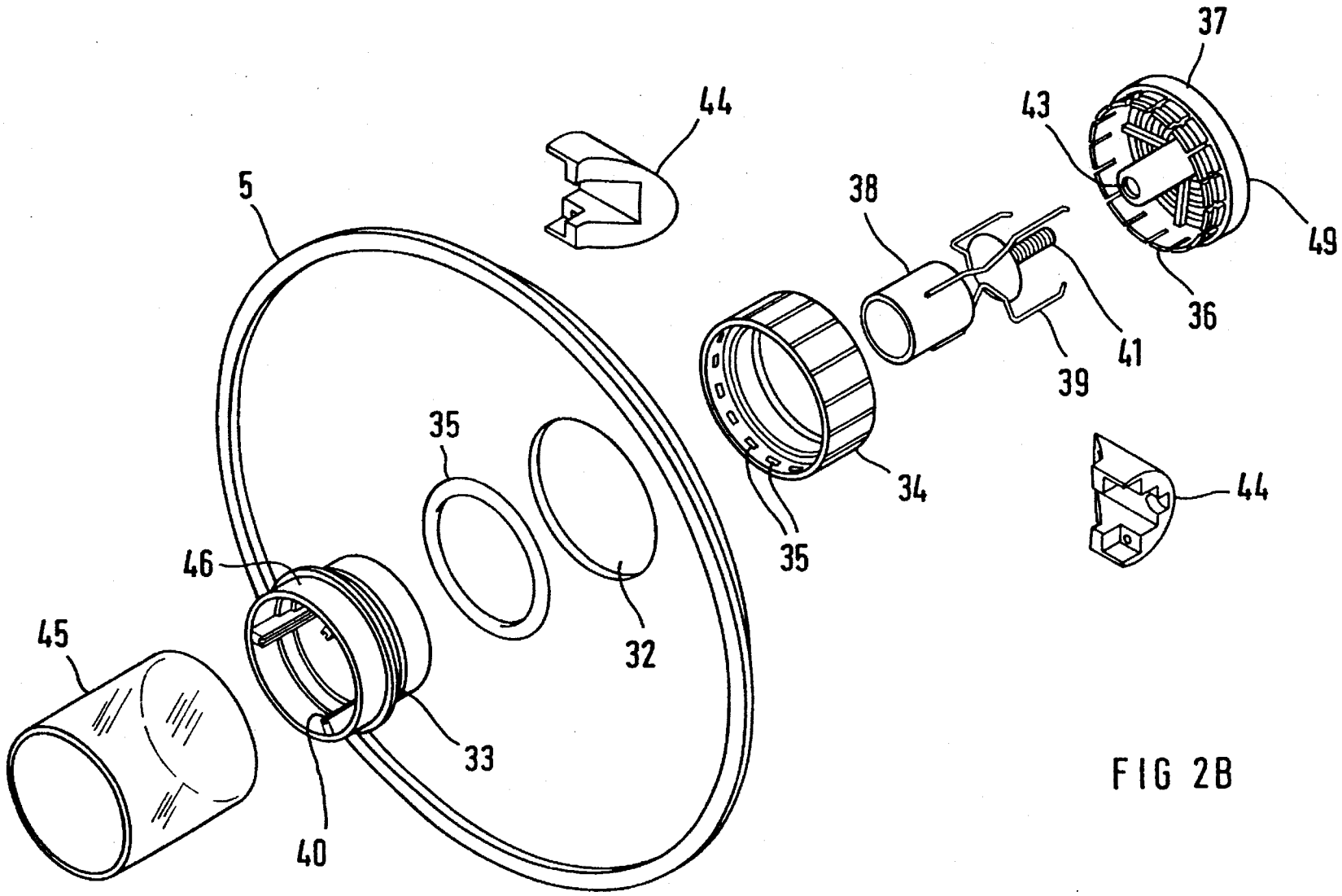
FIG. 2 an exploded perspective view of a remaining portion of the light of FIG. 1.

It may be seen from FIG. 2B that the reflector 5 provided with a central bore 32 can be fixed by two parts 33, 34 connectible by screwing, upon interposition of a O-ring 35. The part 34 fashioned as a threaded ring contains a plurality of tabs 35 at its circumference that correspond with resilient elements 36 of an adjustment ring 37 and, in the assembled condition, form a snap-in connection that axially fixes the parts 34 and 37 that, however, can be turned relative to one another, similar to the components 15 and 8 (FIG. 2A). A screen 38 at least partially concentrically surrounds the lamp 20 in the assembled condition, this screen being carried by retainer elements 39 that are guided in longitudinally proceeding guide channels 40 in the retainer part 33 of the reflector. A threaded pin 41 that corresponds to a threaded nut 43 arranged at the adjustment ring 37 is secured to the retainer elements 39. In the assembled condition, i.e. when the parts 33 and 34 are screwed to one another and the adjustment ring 37 is snapped in place onto the threaded ring 34, the screen 38 can be longitudinally adjusted by turning the adjustment ring 37, as a result whereof the brightness of the light spot produced can be varied in a known way.

A cylindrical glass tube 45 is arranged between reflector 5 and the outside housing 8, the outside diameter of this glass tube 45 essentially corresponding to the outside diameter of the outside housing 8 and, facing toward the reflector, this glass tube 45 being put in place onto a correspondingly fashioned collar 46 of the retainer part 33 and being centered at the front carrier half 7 by guide tabs 47 correspondingly arranged at the circumference. The glass tube 45 is preferably composed of safety glass and is transmissive for visible light but is absorbent or, respectively, reflective for radiation lying in the infrared range. To this end, the tube can either be fabricated of an appropriate material or can also be provided with an appropriate coating.

It derives from the design set forth above that the heat-producing lamp 20 that can preferably be a halogen lamp, is practically shielded against uncontrolled emission of heat—with the exception of entry openings 48 at the face side of the ventilator cap 15 and exit openings 49 at the face side of the adjustment ring 37. The cylindrical parts 45 and 8 that serve as screening and proceed parallel to the axis of the rotationally symmetrical axis of the reflector form a designational heat-guiding means which effects that air can only proceed into the system at the front face of the lamp, i.e. at the ventilator cap 15 and can also emerge therefrom at the opposite side, i.e. at the face end of the adjustment ring 37. A certain chimney effect arises with this heat-guiding system and this can be intensified by turning the ventilator 17 on as warranted, i.e. when the lamp is in use for a longer time.

As already addressed, the replacement of the lamp or light bulb is possible in a very easy way, in that the described structural unit composed of the parts 14 through 21 is axially pulled from the housing 8, whereby a particular advantage is comprised therein that the lamp is voltage-free after the removal of the structural unit, as a result whereof no additional safety measures such as turning the light off at the primary side are required. A further important advantage may be seen therein that— when the glass tube 45 is a safety glass—no additional safety measures need be undertaken which would basically have to be undertaken given halogen lamps because of the relatively high inside pressure ($\geqq 10$ bar), for which purpose an additional anti-explosion means is provided in lights of the prior art.

Although the present invention has been described with reference to a specific embodiment, those of skill in the art will recognize that changes may be made thereto without departing from the scope and spirit of the invention as set forth in the appended claims.

I claim as my invention:

1. A field of action light for operating on a patient, comprising:

an illumination member having a lamp and a reflector with an open front face, said reflector configured for illumination of a desired area of a patient for treatment, and means for eliminating the heat produced by the lamp including a shielding surrounding the lamp and having a closed periphery, the shielding arranged axially parallel to a rotationally symmetrical axis of the reflector and extending to the reflector, said shielding being fashioned transparently in a region in front of the reflector for light charging of the reflector wherein the shielding comprises a cylindrical section of transparent material proximate the reflector and a cylindrical section of non-transparent material that extends forwardly axially therefrom and said shielding having front-side cooling air entry openings lying in front of the reflector and exit openings lying behind the reflector;

wherein the transparent section is composed of a material that absorbs ultraviolet radiation; and wherein the lamp uses a pressurized gas, and the transparent section comprises a cylinder constructed to contain the gas pressure of the lamp is the lamp ruptures.

2. Field of action light according to claim 1, wherein the shielding includes a housing having a structural unit therein which includes a lamp base together with the lamp, said structural unit mounted for easy detachment from the housing.

3. Field of action light according to claim 2, comprising a carrying strap for mounting the light to a structure, and wherein the housing is provided with lateral arms proceeding transversely relative to the symmetrical axis, pivotably connected to the carrying strap.

4. Field of action light according to claim 3, wherein the lateral arms are fashioned bow-shaped.

5. Field of action light according to claim 1, wherein the shielding is tubular.

6. A field of action light for operating on a patient, comprising:

an illumination member having a lamp and a reflector with an open front face, said reflector configured for illumination of a desired area of a patient for treatment, and means for eliminating the heat produced by the lamp including a shielding surrounding the lamp and having a closed periphery, the shielding arranged axially parallel to a rotationally symmetrical axis of the reflector and extending to the reflector, said shielding being fashioned transparently in a region in front of the reflector for light charging of the reflector wherein the shielding comprises a cylindrical section of transparent material proximate the reflector and cylinder section of non-transparent material that extends forwardly axially therefrom and said shielding having front-side cooling air entry openings lying in front of the reflector and exit openings lying behind the reflector;

wherein the shielding includes a housing having a structural unit therein which includes a lamp base together with the lamp, said structural unit mounted for easy detachment from the housing; and wherein the structural unit further comprises a ventilator arranged in the region of the entry openings.

7. Field of action light according to claim 6, wherein the transparent section is composed of a material that absorbs ultraviolet radiation.

8. A field of action light according to claim 6, wherein the lamp base and the housing are provided with wiper contacts that are adapted to automatically engage upon installation of the structural unit within the housing.

9. Field of action light according to claim 6, wherein the structural unit comprises a cylinder shaped ventilator housing holding the ventilator therein.

10. A field of action light for operating on a patient, comprising:

an illumination member having a lamp and a reflector with an open front face and means for eliminating the heat produced by the lamp including a shielding surrounding the lamp and having a closed periphery, the shielding arranged axially parallel to a rotationally symmetrical axis of the reflector and extending to the reflector, said shielding being fashioned transparently in a region in front of the reflector for light charging of the reflector and said shielding having front-side cooling air entry openings lying in front of the reflector and exit openings lying behind the reflector;

wherein the shielding includes a housing having a structural unit therein which includes a lamp base together with the lamp, said structural unit mounted for easy detachment from the housing; and wherein the lamp base and the housing are provided with wiper contacts that are adapted to automatically engage upon installation of the structural unit within the housing; and wherein the structural unit is provided with axial adjustment means rotationally mounted to the housing and connected to the structural unit for adjusting the axial position of the base together with the lamp when the axial adjustment means is turned.

11. A field of action light for operating on a patient, comprising:

an illumination member having a lamp and a reflector with an open front face and means for eliminating the heat produced by the lamp including a shielding surrounding the lamp and having a closed periphery, the shielding arranged axially parallel to a rotationally symmetrical axis of the reflector and extending to the reflector, said shielding being fashioned transparently in a region in front of the reflector for light charging of the reflector wherein the shielding comprises a section of transparent material proximate the reflector and a section of non-transparent material that extends forwardly axially therefrom and said shielding having front-side cooling air entry openings lying in front of the reflector and exit openings lying behind the reflector;

wherein the shielding includes a housing having a structural unit therein which includes a lamp base together with the lamp, said structural unit mounted for easy detachment from the housing;

wherein the structural unit further comprises a ventilator arranged in the region of the entry openings;

wherein the structural unit comprises a cylinder shaped ventilator housing holding the ventilator therein; and a ventilator cap covering an open end of said housing, and axial adjustment means rotationally mounted to the housing and connected to the structural unit for adjusting the axial position of the base together with the lamp when the axial adjustment means is turned, wherein the axial adjustment means comprises a first thread region provided on said ventilator housing and a second thread region provided on a ventilator cap which also provides the entry openings, said first thread region engageable to said second thread region, and wherein the housing and the ventilator cap are provided with catch means that hold the ventilator cap rotatably and axially latchable such that said structural unit together with the base is adjustable in axial direction when the ventilator cap is turned.

12. A field of action light for operating on a patient, comprising:

an illumination member having a lamp and a reflector with an open front face, said reflector configured for illumination of a desired area of a patient for treatment, and means for eliminating the heat produced by the lamp including a shielding surrounding the lamp and having a closed periphery, the shielding arranged axially parallel to a rotationally symmetrical axis of the reflector and extending to the reflector, said shielding being fashioned transparently in a region in front of the reflector for light charging of the reflector wherein the shielding comprises a cylindrical section of transparent material proximate the reflector and a cylindrical section of non-transparent material that extends forwardly axially therefrom and said shielding having front-side cooling air entry openings lying in front of the reflector and exit openings lying behind the reflector;

wherein the shielding includes a housing having a structural unit therein which includes a lamp base together with the lamp, said structural unit mounted for easy detachment from the housing;

a carrying strap for mounting the light to a structure, and wherein the housing is provided with lateral arms proceeding transversely relative to the symmetrical axis, pivotably connected to the carrying strap;

wherein the lateral arms are fashioned bow-shaped; and wherein the housing and two lateral arms secured thereto form a front carrier half and a second housing matable to the housing and two second lateral arms secured to the second housing form a back carrier half, whereby the lateral arms are fashioned such that they partially engage into the second lateral arm in the assembled condition and thereby form a hollow space for the guidance of electrical lines.

13. A field of action light for operating on a patient, comprising:

an illumination member having a lamp and a reflector with an open front face and means for eliminating the heat produced by the lamp including a shielding surrounding the lamp and having a closed periphery, the shielding arranged axially parallel to a rotationally symmetrical axis of the reflector and extending to the reflector, said shielding being fashioned transparently in a region in front of the reflector for light charging of the reflector wherein the shielding comprises a section of transparent material proximate the reflector and a section of non-transparent material that extends forwardly axially therefrom and said shielding having front-side cooling air entry openings lying in front of the reflector and exit openings lying behind the reflector; and wherein the reflector is provided with a central bore for mounting; and said shielding comprises:

a front collar onto which an end of the transparent section opposite to said non-transparent section is installed; and a screen that surrounds the lamp; and a back mount part provided with adjustment means for the axial adjustment of the screen, the light rays being capable of being at least partially screened with the assistance of said screen for the purpose of varying the brightness of the illumination field upon retention of the spacing between lamp and reflector.

14. A field of action light for operating on a patient, comprising:

an illumination member having a lamp and a reflector with an open front face and means for eliminating the heat produced by the lamp including a shielding surrounding the lamp and having a closed periphery, the shielding arranged axially parallel to a rotationally symmetrical axis of the reflector and extending to the reflector, said shielding being fashioned transparently in a region in front of the reflector for light charging of the reflector wherein the shielding comprises a section of transparent material proximate the reflector and a section of non-transparent material that extends forwardly axially therefrom and said shielding having front-side cooling air entry openings lying in front of the reflector and exit openings lying behind the reflector; and wherein the transparent section has an inside coating that reflects ultraviolet radiation.

* * * * *